US006520806B2

(12) United States Patent
Phommachanh

(10) Patent No.: US 6,520,806 B2
(45) **Date of Patent: *Feb. 18, 2003**

(54) TELECOMMUNICATIONS CONNECTOR FOR HIGH FREQUENCY TRANSMISSIONS

(75) Inventor: Chansy Phommachanh, Shakopee, MN (US)

(73) Assignee: ADC Telecommunications, Inc., Eden Prairie, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 48 days.

(21) Appl. No.: 09/378,404

(22) Filed: Aug. 20, 1999

(65) Prior Publication Data

US 2002/0052145 A1 May 2, 2002

(51) Int. Cl.[7] ..... H01R 24/00
(52) U.S. Cl. ..... 439/676
(58) Field of Search ..... 439/676, 941

(56) References Cited

U.S. PATENT DOCUMENTS

| | | | | |
|---|---|---|---|---|
| 4,274,691 | A | | 6/1981 | Abernethy et al. |
| 4,406,509 | A | | 9/1983 | Jagen |
| 4,698,025 | A | | 10/1987 | Silbernagel et al. |
| 5,030,123 | A | | 7/1991 | Silver |
| 5,071,371 | A | | 12/1991 | Harwarth et al. |
| 5,156,554 | A | | 10/1992 | Rudoy et al. |
| 5,186,647 | A | | 2/1993 | Denkmann et al. |
| 5,238,426 | A | | 8/1993 | Arnett |
| 5,299,956 | A | | 4/1994 | Brownell et al. |
| 5,310,363 | A | | 5/1994 | Brownell et al. |
| 5,362,257 | A | | 11/1994 | Neal et al. |
| 5,399,107 | A | | 3/1995 | Gentry et al. |
| 5,580,257 | A | | 12/1996 | Harwath |
| 5,639,266 | A | | 6/1997 | Patel |
| 5,674,093 | A | | 10/1997 | Vaden |
| 5,687,478 | A | * | 11/1997 | Belopolsky ..... 439/676 |

(List continued on next page.)

FOREIGN PATENT DOCUMENTS

| | | |
|---|---|---|
| EP | 0 782 221 A2 | 7/1997 |
| GB | 2314466 A | 12/1997 |
| WO | WO86/00474 | 1/1986 |

OTHER PUBLICATIONS

The Siemon Company Catalog pages—front cover page through page 1.39, and back cover page, dated 1999.

*Primary Examiner*—Paula Bradley
*Assistant Examiner*—James Harvey
(74) *Attorney, Agent, or Firm*—Merchant & Gould P.C.

(57) ABSTRACT

The present disclosure relates to an electrical connector including a plurality of contact springs having contact regions aligned generally along a single line of contact. The contact springs include rearwardly and forwardly facing contact springs that are positioned next to one another. The rearwardly facing contact spring includes a distal portion positioned behind the contact line and a proximal portion positioned in front of the contact line. The forwardly facing contact spring includes a distal portion positioned in front of the line of contact and a proximal portion positioned behind the line of contact. The rearwardly facing contact spring and the forwardly facing contact spring are shaped such that when the rearwardly and forwardly facing contact springs are in a deflective orientation: (a) the distal portion of the rearwardly facing contact spring defines an angle greater than 10° relative to the proximal portion of the forwardly facing contact spring; and (b) the proximal portion of the rearwardly facing contact spring is defines an angle greater than 10° relative to the distal portion of the forwardly facing contact spring.

33 Claims, 7 Drawing Sheets

U.S. PATENT DOCUMENTS

| | | | | | |
|---|---|---|---|---|---|
| 5,700,167 | A | | 12/1997 | Pharney et al. | |
| 5,713,764 | A | | 2/1998 | Brunker et al. | |
| 5,716,237 | A | | 2/1998 | Conorich et al. | |
| 5,735,714 | A | | 4/1998 | Orlando et al. | |
| 5,759,070 | A | | 6/1998 | Belopolsky | |
| 5,779,503 | A | | 7/1998 | Tremblay et al. | |
| 5,791,942 | A | | 8/1998 | Patel | |
| 5,791,943 | A | | 8/1998 | Lo et al. | |
| 5,879,199 | A | | 3/1999 | Belopolsky | |
| 5,911,602 | A | | 6/1999 | Vaden | |
| 5,938,479 | A | | 8/1999 | Paulson et al. | |
| 5,941,734 | A | | 8/1999 | Ikeda et al. | |
| 6,083,052 | A | * | 7/2000 | Adams et al. | 439/941 |
| 6,086,428 | A | * | 7/2000 | Pharney et al. | 439/676 |
| 6,089,923 | A | | 7/2000 | Phommachanh | |
| 6,120,330 | A | | 9/2000 | Gwiazdowski | |
| 6,126,476 | A | | 10/2000 | Viklund et al. | |

* cited by examiner

TELECOMMUNICATIONS CONNECTOR FOR HIGH FREQUENCY TRANSMISSIONS

FIELD OF THE INVENTION

The present invention relates generally to electrical connectors, and more particularly to electrical connectors for use in telecommunications systems utilizing high frequency transmissions where interference from crosstalk is a concern.

BACKGROUND OF THE INVENTION

Modular connectors such as modular plugs and modular jacks are commonly used in the telecommunications industry. FIG, 1 illustrates an exemplary modular connector 20 (e.g., an RJ45 connector). The connector 20 includes eight spring contacts numbered from one to eight. The eight contacts form four separate circuits or pairs for conveying twisted pair (e.g., tip and ring) signals. FIG, 1 shows a conventional pairing configuration in which springs 4 and 5 form a first circuit, springs 3 and 6 form a second circuit, springs 1 and 2 form a third circuit, and springs 7 and 8 form a fourth circuit.

Crosstalk can be a significant source of interference in telecommunications systems. Crosstalk is typically caused by the unintentional transfer of energy from one signal pair to another. Commonly, the transfer of energy is caused by inductive or capacitive coupling between the conductors of different circuits. Crosstalk is particularly problematic in modular connectors because of the close spacing of the contact springs. The most severe crosstalk frequently occurs between the two inside circuits of a modular connector (i.e., the circuits formed by contact springs 4, 5 and 3, 6).

The Telecommunication Industry Association/Electronics Industry Alliance (TIA/EIA) provides specifications relating to the electrical performance of connectors. Proposed TIA/EIA category 6 specifications outline the electrical performance of a connector up to 250 mhz, and TIA/EIA category 5 specifications outline the electrical performance of a connector up to 100 mhz. Most contact springs available in the market today are designed for use in category 5 connectors. However, the degrading effects of crosstalk intensify with increased transmission frequencies. Therefore, many contact springs that comply with category 5 connector specifications, will not satisfy the requirements for a category 6 connector. Hence, what is needed is an improved connector that inhibits the effects of crosstalk even at high frequencies.

SUMMARY OF THE INVENTION

One aspect of the present invention relates to an electrical connector having contact springs configured to inhibit crosstalk at high transmission frequencies.

Another aspect of the present invention relates to an electrical connector having contact springs having regions arranged in non-parallel configurations adapted for inhibiting cross-talk between the contact springs.

A further aspect of the present invention relates to an electrical connector having contact springs that rapidly diverge from one another as the contact springs extend away from contact regions of the springs.

Still another aspect of the present invention relates to an electrical connector including a plurality of contact springs having contact regions aligned generally along a single line of contact. The contact springs include rearwardly and forwardly facing contact springs that are positioned next to one another. The rearwardly facing contact spring includes a distal portion positioned behind the contact line and a proximal portion positioned in front of the contact line. The forwardly facing contact spring includes a distal portion positioned in front of the line of contact and a proximal portion positioned behind the line of contact. The rearwardly facing contact spring and the forwardly facing contact spring are shaped such that when the rearwardly and forwardly facing contact springs are in a deflected orientation: (a) the distal portion of the rearwardly facing contact spring defines an angle greater than 10° relative to the proximal portion of the forwardly facing contact spring; and (b) the proximal portion of the rearwardly facing contact spring defines an angle greater than 10° relative to the distal portion of the forwardly facing contact spring.

A variety of advantages of the invention will be set forth in part in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several aspects of the invention and together with the description, serve to explain the principles of the invention. A brief description of the drawings is as follows.

DETAILED DESCRIPTION

Reference will now be made in detail to exemplary aspects of the present invention that are illustrated in the accompanying drawings. Wherever possible, the same reference numbers will be used throughout the drawings to refer to the same or like parts.

Figure 2:
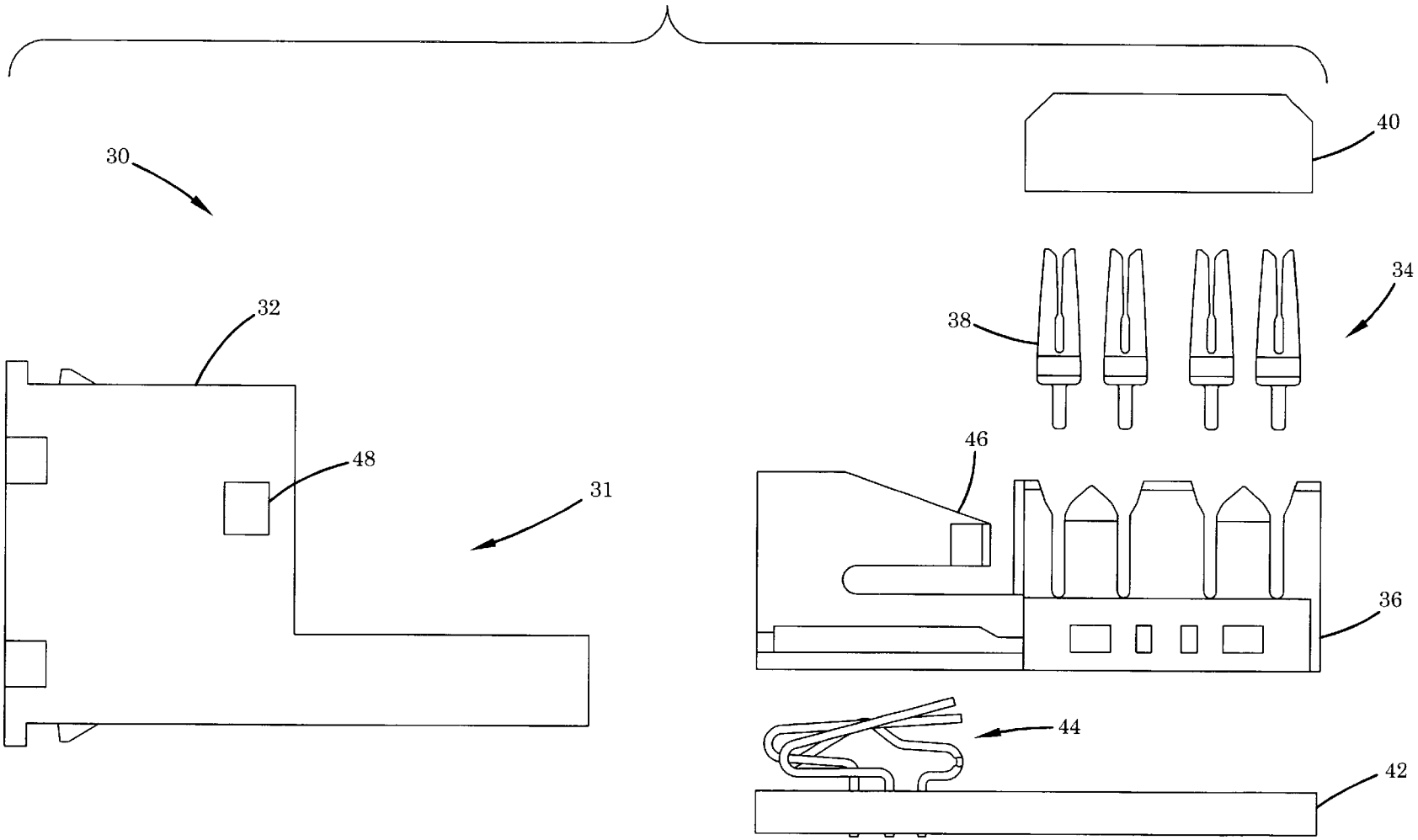
FIG. 2 is an exploded, elevational view of a modular jack constructed in accordance with the principles of the present invention.

FIG. 2 illustrates a modular jack 30 constructed in accordance with the principles of the present invention. The modular jack 30 includes a housing 32 and an insert assembly 34 adapted to snap fit within a back side 31 of the housing 32. The insert assembly 34 includes a connector mount 36, a plurality of insulation displacement terminals 38, a termination cap 40, a circuit board 42, and a plurality of contact springs 44 (e.g., eight contact springs) mounted on the circuit board 42. When assembled, the insulation displacement terminals 38 and the termination cap 40 mount at a top side of the connector mount 36, while the circuit board 42 mounts to a bottom side of the connector mount 36. As so assembled, the contact springs 44 project upward between resilient locking tabs 46 (only one shown) of the connector mount 36. The locking tabs 46 are adapted to snap fit within corresponding openings 48 defined by the housing 32. Tracings (not shown) on the circuit board 42 provide electrical connections between the contact springs 44 and respective ones of the insulation displacement terminals 38. Further details relating to an exemplary housing and connector mount suitable for practicing the present invention are disclosed in U.S. Pat. No. 6,234,836, filed Jun. 7, 1999, that is hereby incorporated by reference. Details relating to a circuit board tracing configuration suitable for use with the present invention are disclosed in U.S. Pat. No. 6,089,923, filed Aug. 20, 1999, and which is hereby incorporated by reference.

Figure 3:
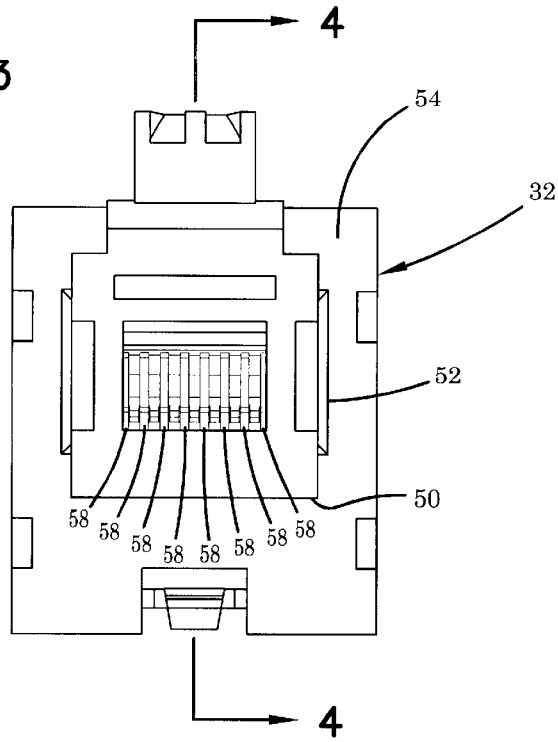
FIG. 3 is a front view of the jack of FIG. 2 with a modular plug inserted therein.
Figure 4:
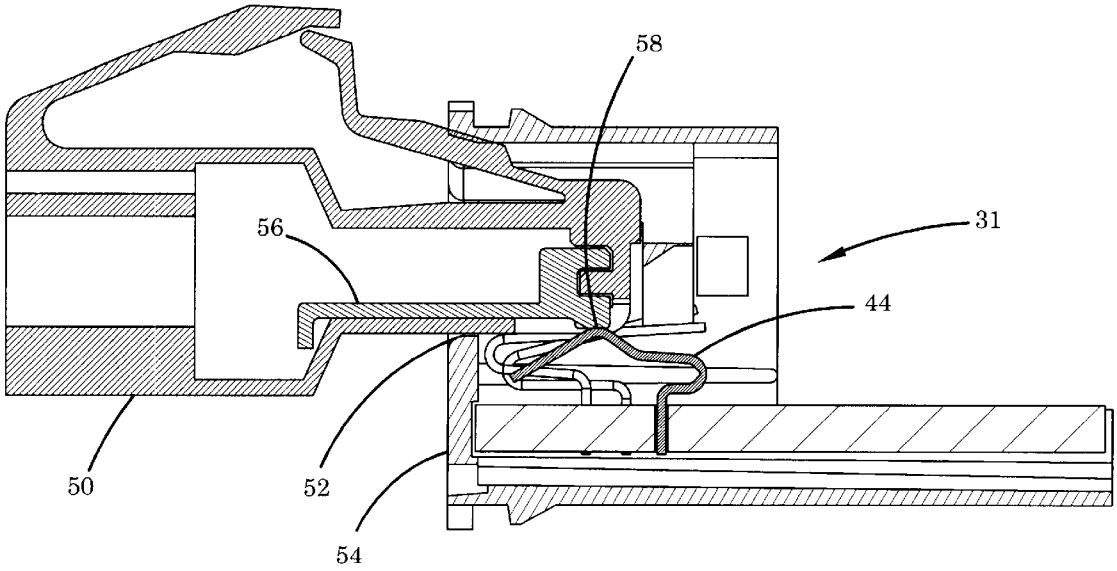
FIG. 4 is a cross-sectional view taken along section line 4—4 of FIG. 3.

FIG. 3 shows a modular plug 50 inserted within a port 52 defined by a front side 54 of the housing 32. The plug 50 includes eight contacts 56 that provide electrical connections with the contact springs 44 of the modular jack 30 when the plug 50 is inserted within the port 52. For example, FIG. 4 shows one of the contacts 56 in electrical contact with one of the contact springs 44. As shown in FIG. 4, the contact springs 44 have been pushed into a deflected orientation by the contacts 56. For the purpose of this application, the phrase "deflected orientation" is intended to mean the orientation of the contact springs 44 when the plug 50 is inserted within the port 52. For clarity, the connector mount 36 is not shown in FIG. 4.

Electrical contact between the contacts 56 and the contact springs 44 is preferably made along a single line of contact 58. The line of contact 58 is best shown schematically at FIG. 5A. For clarity purposes, the plug 50 is not shown in FIG. 5A such that the springs 44 are more clearly visible.

Figures 5A, 5B, 5C:
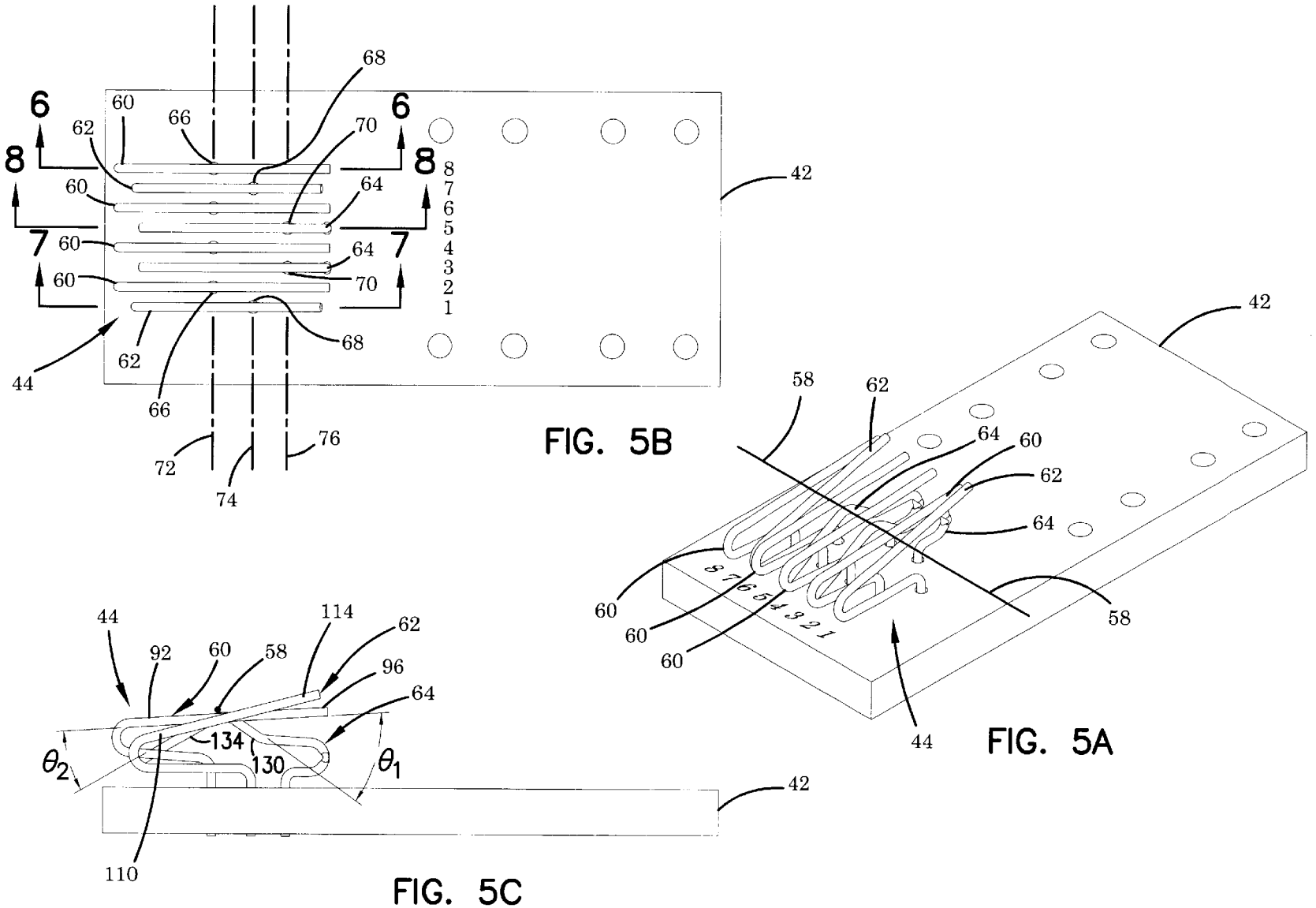
FIG. 5A is a perspective view of the springs and circuit board of the modular jack of FIG. 2, the springs are illustrated in a deflected orientation.
FIG. 5B is a top, plan view of the springs and circuit board of FIG. 5A.
FIG. 5C is an elevational view of the circuit board and deflected springs of FIG. 5A.

FIGS. 5A–5C illustrate the circuit board 42 and the contact springs 44 in isolation from the remainder of the modular jack 30. In all of FIGS. 5A–5C, the contact springs 44 have been depicted in the deflected orientation of FIG. 4.

Figure 1:
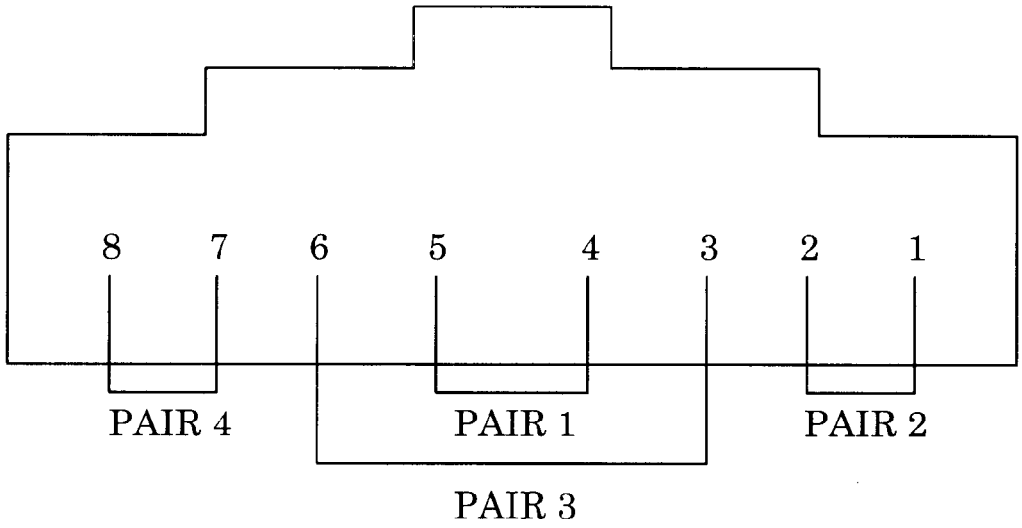
FIG. 1 ( PRIOR ART )
FIG. 1 schematically shows a prior art modular jack.

Referring now to FIG. 5B, the contact springs 44 are located at eight separate spring positions numbered 1–8. Similar to the prior art pin assignment of FIG. 1, the contact springs at positions 4 and 5 preferably form a first pair, the contact springs at positions 3 and 6 preferably perform a second pair, the contact springs at positions 1 and 2 preferably form a third pair, and the contact springs at positions 7 and 8 preferably form a fourth pair.

The contact springs 44 preferably include springs having three different geometric configurations. For example, the contact springs 44 are shown including four front springs 60, two middle springs 62 and two rear springs 64. Preferably, the front springs 60 are located at spring positions 2, 4, 6 and 8; the middle springs 62 are located at spring positions 1 and 7; and the rear springs 64 are located at spring positions 3 and 5. As will be described later in the specification, the front and middle springs 60 and 62 preferably comprise rearwardly facing springs, and the rear springs 64 preferably comprise forwardly facing springs.

Referring again to FIG. 5B, the front, middle and rear springs 60, 62 and 64 respectively include terminal ends 66, 68 and 70 that terminate within the circuit board 42. The terminal ends 66 of the front springs 60 are aligned along a front reference line 72, the terminal ends 68 of the middle springs 62 are aligned along a middle reference line 74, and the terminal ends 70 of the rear springs 64 are aligned along a rear reference line 76. The middle reference line 74 is positioned between the front and rear reference lines 72 and 76. Preferably, the reference lines 72, 74 and 76 are substantially parallel. The spacing between the reference lines 72, 74 and 76 provide staggering between the terminal ends 66, 68 and 70. This staggering is advantageous because additional space is provided for terminating the springs 44 at the circuit board 42 (e.g., clearance for solder pads is provided). Clearance is also provided for allowing transmission lines to be passed between the springs 44.

Figure 6:
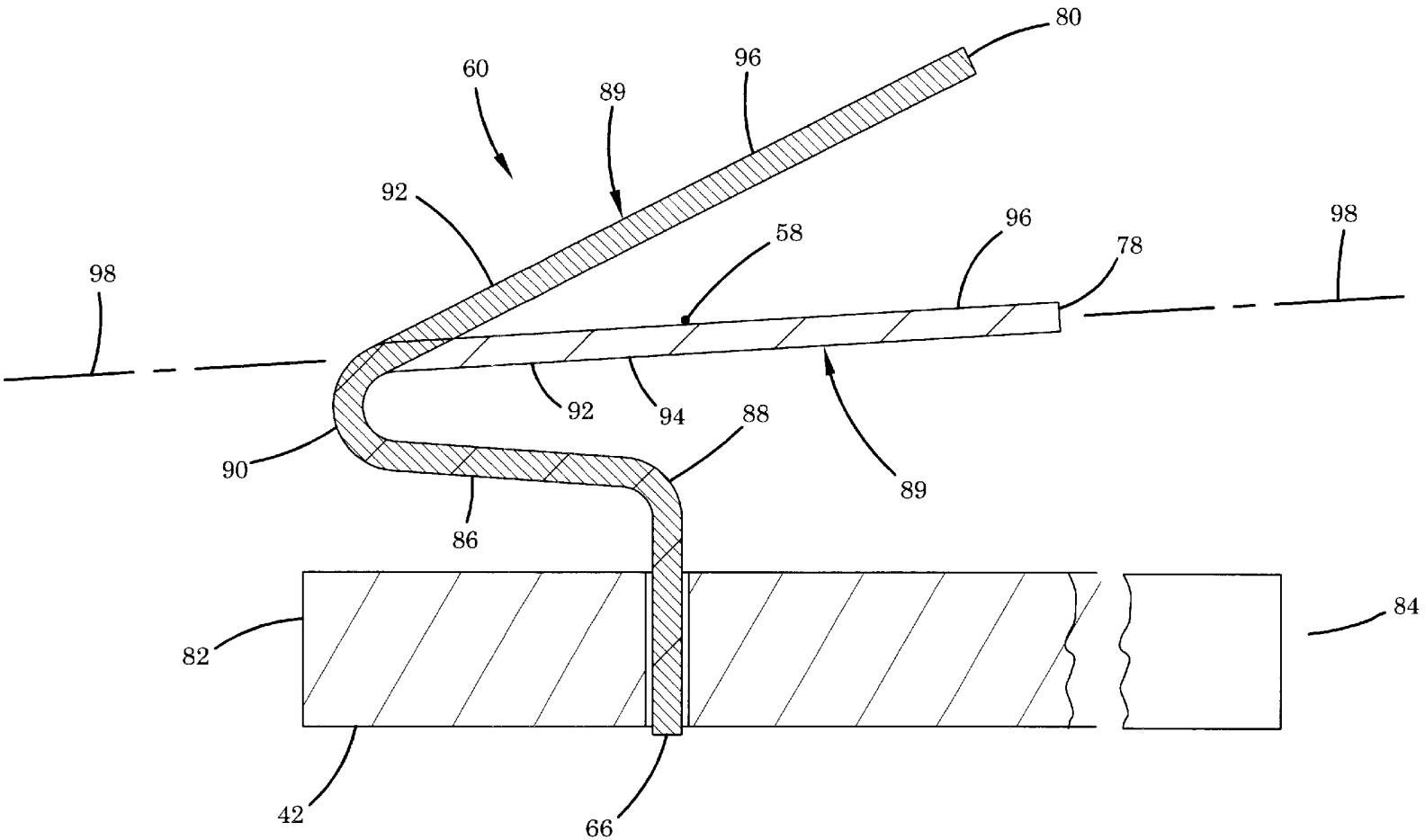
FIG. 6 is a cross-sectional view taken along section line 6—6 of FIG. 5B, the spring is shown in a deflected orientation and in a non-deflected orientation.

FIG. 6 shows one of the front springs 60 in both a deflected orientation 78 and in a non-deflected orientation 80. The terminal end 66 of the front spring 60 is shown extending through the circuit board 42. The circuit board 42 includes a front end 82 adapted to be positioned at the front side 54 of the housing 32 and a rear end 84 adapted to be positioned at the rear side 31 of the housing 32.

Referring still to FIG. 6, the terminal end 66 of the front spring 60 extends vertically upward from the circuit board 42. A forward extension 86 extends in a forward direction from the terminal end 66. A first bend 88 (e.g,., a bend of about 90 degrees) interconnects the terminal end 66 and the forward extension 86. The forward extension 86 preferably extends slightly upward as it extends in the forward direction. A second bend 90 reverses the direction in which the forward extension 86 extends. For example, the second bend reverses the direction of the spring 60 from a forward direction at the forward extension 86, to a rearward direction at a proximal portion 92 of the front spring 60.

The proximal portion 92 extends from the second bend 90 to a contact region 94 that corresponds to the line of contact 58 at which the spring 60 will contact its respective contact 56 of the plug 50. The spring 50 further includes a distal portion 96 that extends from the contact region 94 toward the rear end 84 of the circuit board 42. Preferably, the proximal and distal portions 92 and 96 are aligned along a single straight line 98.

The front spring 60 can be referred to as a rearwardly facing spring because the distal portion 96 extends from the contact region 94 toward the rear end 84 of the circuit board 42. The proximal and distal portions 92 and 96 cooperate to form a resilient cantilever 89 having a base at the second bend 90. When moving between the deflected and non-deflected orientations 78 and 80, the cantilever 89 flexes primarily it's base (e.g., at the second bend 90).

Figure 7:
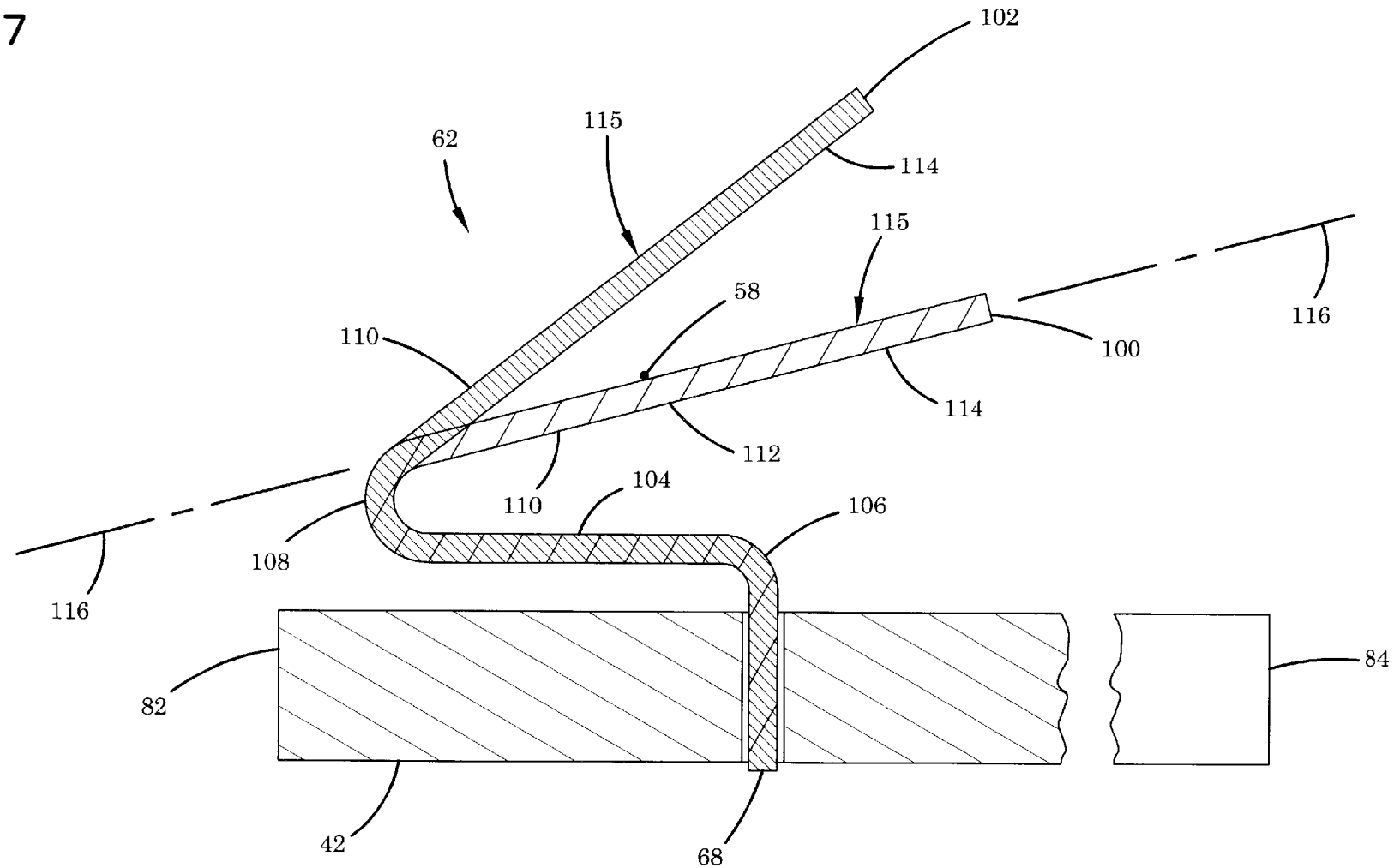
FIG. 7 is a cross-sectional view taken along section line 7—7 of FIG. 5B, the spring is shown in a deflected orientation and in a non-deflected orientation.

FIG. 7 illustrates one of the middle springs 62 in both a deflected orientation 100 and in a non-deflected orientation 102. The terminal end 68 of the middle spring 62 extends vertically upward from the circuit board 42. A forward extension 104 extends in a forward direction from the terminal end 68. A first bend 106 (e.g., approximately a 90 degree bend) provides a transition between the terminal end 68 and the forward extension 104. A second bend 108 reverses the direction of extension of the forward extension 104. From the second bend 108, a proximal portion 110 of the middle spring 62 extends in a rearward direction to a contact region 112 that corresponds to the line of contact 58 at which the spring 62 will contact its respective contact 56 of the plug 50.

A distal portion 114 of the contact spring 62 extends from the contact region 112 in a rearward direction toward the rear end 84 of the circuit board 42. Preferably, the proximal portion 110 and the distal portion 114 are aligned along a single straight line 116 and form a cantilever 115 having a base end at the second bend 108. When moving between the deflected and non-deflected orientations 100 and 102, the cantilever 115 flexes primarily at the second bend 108. The spring 62 can be referred to as a rearwardly facing spring because the distal portion 114 extends in a rearward direction from the contact region 112.

Figure 8:
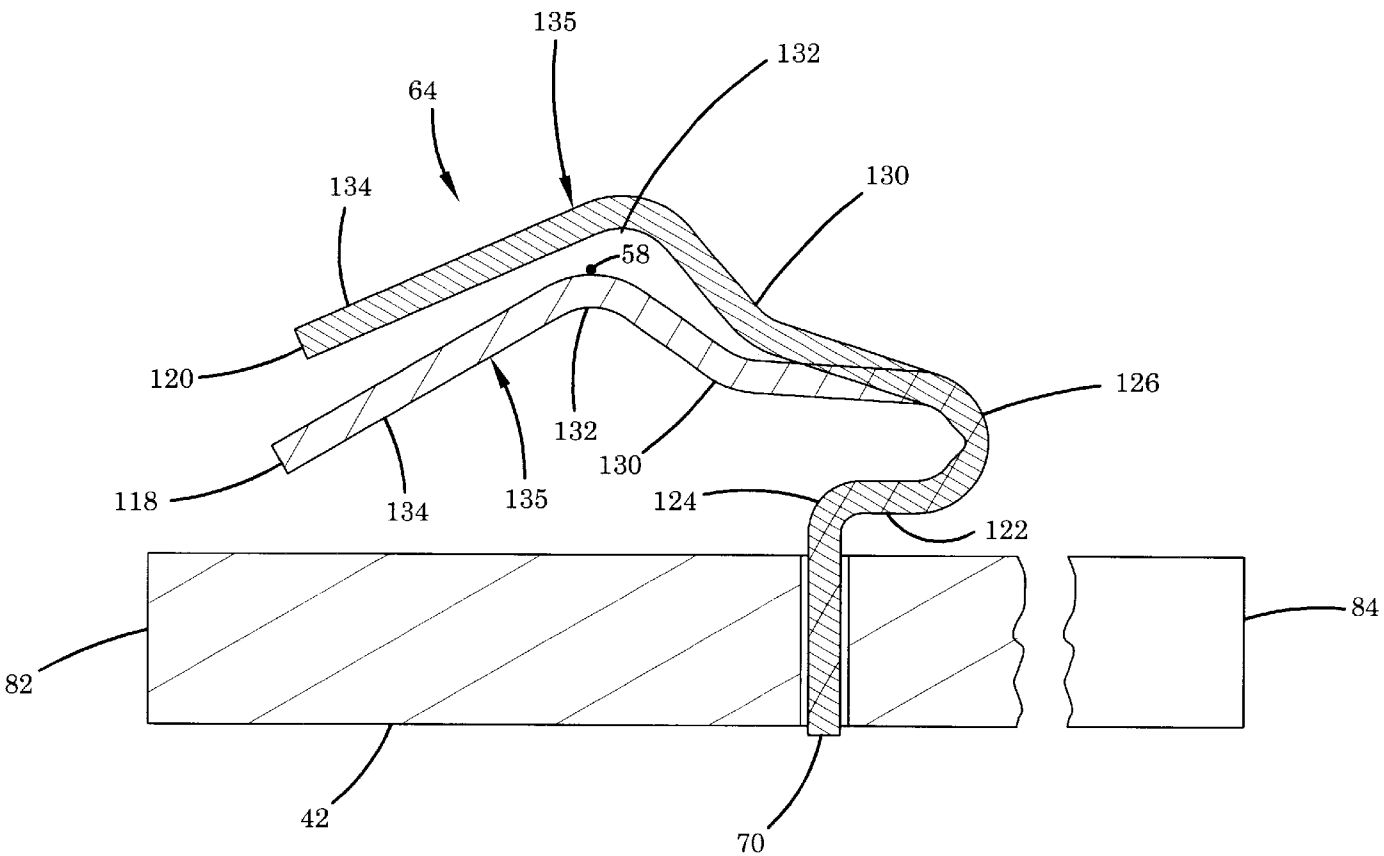
FIG. 8 is a cross-sectional view taken along section line 8—8 of FIG. 5B, the spring is shown in a deflected orientation and in a non-deflected orientation.

FIG. 8 illustrates one of the rear springs 64 in both a deflected orientation 118 and a non-deflected orientation 120. The terminal end 70 of the rear spring 64 extends perpendicularly from the circuit board 42. A rearward extension 122 extends in a rearward direction from the terminal end 70. A first bend 124 (e.g., about a 90° bend) provides a transition between the terminal end 70 and the rearward extension 122. A second bend 126 reverses the direction of extension of the rearward extension 122. A proximal portion 130 extends from the second bend 126 in a forward direction to a contact region 132 of the spring 64. The contact region 132 corresponds to the line of contact 58 at which the spring 64 will electrically contact one of the contacts 56 of the plug 50. A distal portion 134 of the rear spring 64 preferably extends in a forward direction from the contact region 132 toward the front end 82 of the circuit board 42.

The distal and proximal portions 134 and 130 are not aligned along a common straight line. Instead, the proximal and distal portions 130 and 134 are preferably aligned at an obtuse angle relative to one another. The contact region 132 is located at an apex between the proximal and distal portions 130 and 134, and the proximal and distal portions 130 and 134 extend away from the contact region 132 in a direction generally toward the circuit board 42. The proximal and distal portions 130 and 134 form a cantilever 135 having a base end at the second bend 126. When moving between the deflected and non-deflected orientations 118 and 120, the cantilever 135 flexes primarily at the second bend 126. The spring 64 can be referred to as a forwardly facing spring because the distal portion 134 extends in a forward direction from the contact region 132.

An important aspect of the present invention is to inhibit crosstalk at spring positions 3–6. To accomplish this, the front and rear springs 60 and 64 are alternated between positions 3–6. For example, rear springs 64 are located at positions 3 and 5, and front springs 60 are located at positions 4 and 6. The front and rear springs 60 and 64 are positioned and shaped to minimize any parallel relationships between the contact springs at positions 3–6. By providing non-parallel relationships between the springs at positions 3–6, capacitive coupling can be inhibited.

Referring to FIG. 5C, the contact springs 44 are shown in a deflected orientation. As illustrated, the distal portions 96 of the front springs 60 (i.e., the rearwardly facing contact springs) define an angle $\theta_1$ relative to the proximal portions 130 of the rear springs 64 (i.e., the forwardly facing contact springs) that is preferably greater than 10°. In other embodiments, the angle $\theta_1$ is greater than 15°, 20°, 25°, 30°, or 35°. In one particular embodiment of the present invention, the angle $\theta_1$ is about 38.5°.

Referring still to FIG. 5C, proximal portions 92 of the front springs 60 (i.e., the rearwardly facing contact springs) define an angle $\theta_2$ relative to the distal portions 134 of the rear springs 64 (i.e., the forwardly facing contact springs) that is preferably greater than 10°. In certain embodiments of the present invention, the angle $\theta_2$ is greater than 15°, 20° or 25°. In one particular embodiment of the present invention, the angle $\theta_2$ is a about 26.6°.

To further reduce crosstalk, it is also noted that the distal portions 114 of the middle springs 62 are arranged in a non-parallel relationship with respect to the distal portions 96 of the front springs 60. Additionally, the proximal portions 110 of the middle springs 62 are arranged in a non-parallel relationship with respect to the proximal portions 92 of the front springs 60.

The above-described configurations assist in reducing crosstalk between the springs located at positions 3–6 because the distal portions 96 of the front springs 60 relatively quickly diverge from a parallel relationship with respect to the proximal portions 130 of the rear springs 64, and the proximal portions 92 of the front springs 60 relatively quickly diverge from a parallel relationship with respect to the distal portions 134 of the rear springs 64. The divergence preferably initiates as the springs 60, 64 extend away from the line of contact 58. Therefore, significant portions of the springs 60 and 64 are spaced relatively far apart thereby reducing the intensity of capacitive coupling.

As shown in FIG. 5B, the front springs 60 are shown at positions 4 and 6 and the rear springs 64 are shown at positions 3 and 5. It will be appreciated that this positioning could be reversed such that the front springs 60 are located at positions 3 and 5, and the rear springs 64 are located at positions 4 and 6. Also, in other embodiments, forwardly facing springs can be used at positions 1, 2, 7 and 8; and forwardly and rearwardly facing contacts can be alternated at positions 3–6. In still another embodiment, forwardly facing contacts and rearwardly facing contacts can be alternated throughout positions 1–8.

With regard to the foregoing description, it is to be understood that changes may be made in detail without departing from the scope of the present invention. It is intended that the specification and depicted aspects of the invention may be considered exemplary, only, with a true scope and spirit of the invention being indicated by the broad meaning of the following claims.

What is claimed is:

1. An electrical connector comprising:

a plurality of contact springs having contact regions aligned generally along a single line of contact;

the plurality of contact springs including a rearwardly facing contact spring, the contact region of the rearwardly facing contact spring being positioned between a distal portion and a proximal portion of the rearwardly facing contact spring, the distal portion of the rearwardly facing contact spring being positioned behind the contact line and the proximal portion of the rearwardly facing contact spring being positioned in front of the contact line;

the plurality of contact springs including a forwardly facing contact spring positioned next to the rearwardly facing contact spring, the contact region of the forwardly facing contact spring being positioned between a distal portion and a proximal portion of the forwardly facing contact spring, the distal portion of the forwardly facing contact spring being positioned in front of the line of contact and the proximal portion of the forwardly facing contact spring being positioned behind the line of contact;

the rearwardly facing contact spring and the forwardly facing contact spring being shaped such that when the rearwardly and forwardly facing contact springs are in a deflected orientation:

a) the distal portion of the rearwardly facing contact spring defines an angle $\theta_1$ relative to the proximal portion of the forwardly facing contact spring that is greater than 10 degrees; and b) the proximal portion of the rearwardly facing contact defines an angle $\theta_2$ relative to the distal portion of the forwardly facing contact spring that is greater than 10 degrees.

2. The electrical connector of claim 1, wherein the angle $\theta_1$ is greater than fifteen degrees, and the angle $\theta_2$ is greater than fifteen degrees.

3. The electrical connector of claim 1, wherein the angle $\theta_1$ is greater than twenty degrees, and the angle $\theta_2$ is greater than twenty degrees.

4. The electrical connector of claim 1, wherein the angle $\theta_1$ is greater than twenty degrees, and the angle $\theta_2$ is greater than thirty degrees.

5. The electrical connector of claim 1, wherein the angle $\theta_1$ is greater than the angle $\theta_2$.

6. The electrical connector of claim 1, wherein the distal and proximal portions of the rearwardly facing contact spring are aligned along a common line, and the distal and proximal portions of the forwardly facing contact spring are not aligned along a common line.

7. The electrical connector of claim 6, wherein the distal and proximal portions of the forwardly facing contact spring are aligned at an obtuse angle relative to one another.

8. The electrical connector of claim 6, wherein the forwardly and rearwardly facing contact springs are mounted on a circuit board, and the distal and proximal portions of the forwardly facing contact spring extend from the contact region of the forwardly facing contact spring toward the circuit board.

9. The electrical connector of claim 1, wherein the distal and proximal portions of the forwardly facing contact spring are not aligned along a common line.

10. The electrical connector of claim 9, wherein the distal and proximal portions of the forwardly facing contact spring are aligned at an obtuse angle relative to one another.

11. The electrical connector of claim 1, wherein the contact springs are mounted on a circuit board, and the distal and proximal portions of the forwardly facing contact spring extend from the contact region of the forwardly facing contact spring toward the circuit board.

12. The electrical connector of claim 1, wherein the distal and proximal portions of one of the rearwardly and forwardly facing contact springs are aligned along a common line, and the distal and proximal portions of the other of the rearwardly and forwardly facing contact springs are not aligned along a common line.

13. The electrical connector of claim 12, wherein the distal and proximal portions of the other of the forwardly and rearwardly facing contact springs are aligned at an obtuse angle relative to one another.

14. The electrical connector of claim 12, wherein the contact springs are mounted on a circuit board, and the distal and proximal portions of the other contact spring extend from the contact region of the other contact spring toward the circuit board.

15. The electrical connector of claim 1, wherein the distal and proximal portions of one of the forwardly and rearwardly facing contact springs are not aligned along a common line.

16. The electrical connector of claim 1, wherein the distal and proximal portions of one of the forwardly and rearwardly facing contact springs are aligned at an obtuse angle relative to one another.

17. The electrical connector of claim 1, wherein the contact springs are mounted on a circuit board, and the distal and proximal portions of one of the forwardly and rearwardly facing contact springs extend from the contact region of the one toward the circuit board.

18. The electrical connector of claim 1, wherein the distal portions of the forwardly and rearwardly facing contact springs comprise free end portions.

19. An electrical connector comprising:

a plurality of contact springs having contact regions aligned generally along a single line of contact, the contact springs being oriented at positions 1 to 8 ;

the contact springs including a first set of rearwardly facing contact springs, the contact regions of the rearwardly facing contact springs being positioned between distal and proximal portions of the rearwardly facing contact springs, the distal portions of the rearwardly facing contact springs being positioned behind the contact line and the proximal portions of the rearwardly facing contact springs being positioned in front of the contact line;

the contact springs including a second set of forwardly facing contact springs, the contact regions of the forwardly facing contact springs being positioned between distal and proximal portions of the forwardly facing contact springs, the distal portions of the forwardly facing contact springs being positioned in front of the line of contact and the proximal portions of the forwardly facing contact springs being positioned behind the line of contact;

the contact springs of one of the first and second sets occupying one of: i) positions 3 and 5; and ii) positions 4 and 6;

the contact springs of the other of the first and second sets occupying the remainder of positions 1 to 8;

the rearwardly facing contact springs and the forwardly facing contact springs being shaped such that when the rearwardly and forwardly facing spring contacts are in a deflected orientation:

a) the distal portions of the rearwardly facing contact spring define angles $\theta_1$ relative to the proximal portions of the forwardly facing contact spring that are greater than 10 degrees; and b) the proximal portions of the rearwardly facing contact define angle $\theta_2$ relative to the distal portions of the forwardly facing contact spring that are greater than 10 degrees.

20. The electrical connector of claim 19, wherein the angles $\theta_1$ are greater than fifteen degrees, and the angles $\theta_2$ are greater than fifteen degrees.

21. The electrical connector of claim 19, wherein the angles $\theta_1$ are greater than twenty degrees, and the angles $\theta_2$ are greater than twenty degrees.

22. The electrical connector of claim 19, wherein the angles $\theta_1$ are greater than twenty degrees, and the angles $\theta_2$ are greater than thirty degrees.

23. The electrical connector of claim 19, wherein the angles $\theta_1$ are greater than the angles $\theta_2$ .

24. An electrical connector comprising:

a plurality of contact springs having contact regions aligned generally along a single line of contact, the contact springs being oriented at positions 1 to 8, the contact springs including rearwardly facing contact springs at positions 1, 2, 4, 6, 7 and 8, the contact regions of the rearwardly facing contact springs being positioned between distal and proximal portions of the rearwardly facing contact springs, the distal portions of the rearwardly facing contact springs being positioned behind the contact line and the proximal portions of the rearwardly facing contact springs being positioned in front of the contact line;

the contact springs including forwardly facing contact springs at positions 3 and 5, the contact regions of the forwardly facing contact springs being positioned between distal and proximal portions of the forwardly facing contact springs, the distal portions of the forwardly facing contact springs being positioned in front of the line of contact and the proximal portions of the forwardly facing contact springs being positioned behind the line of contact;

the contact springs at positions 1, 4, 6 and 8 having terminal ends aligned along a first reference line;

the contact springs at positions 3 and 5 having terminal ends aligned along a second reference line spaced-apart from the first reference line;

the contact springs at positions 2 and 7 having terminal ends aligned along a third reference line positioned between the first and second reference lines;

the rearwardly facing contact springs and the forwardly facing contact springs being shaped such that when the rearwardly and forwardly facing spring contacts are in a deflected orientation:

a) the distal portions of the rearwardly facing contact spring define angles $\theta_1$ relative to the proximal portions of the forwardly facing contact spring that are greater than 10 degrees; and b) the proximal portions of the rearwardly facing contact define angle $\theta_2$ relative to the distal portions of the forwardly facing contact spring that are greater than 10 degrees.

25. The electrical connector of claim 24, wherein the angles $\theta_1$ are greater than fifteen degrees, and the angles $\theta_2$ are greater than fifteen degrees.

26. The electrical connector of claim 24, wherein the angles $\theta_1$ are greater than twenty degrees, and the angles $\theta_2$ are greater than twenty degrees.

27. The electrical connector of claim 24, wherein the angles $\theta_1$ are greater than twenty degrees, and the angles $\theta_2$ are greater than thirty degrees.

28. The electrical connector of claim 24, wherein the angles $\theta_1$ are greater than the angles $\theta_2$ .

29. An electrical connector comprising:

a plurality of contact springs having contact regions aligned generally along a single line of contact;

the plurality of contact springs including a rearwardly facing contact spring having a first portion positioned behind the contact line and a second portion positioned in front of the contact line;

the plurality of contact springs including a forwardly facing contact spring positioned next to the rearwardly facing contact spring, the forwardly facing contact spring having a first portion positioned in front of the contact line and a second portion positioned behind the contact line;

the rearwardly facing contact spring and the forwardly facing contact spring being shaped such that when the rearwardly and forwardly facing contact springs are in a deflected orientation:

a) the first portion of the rearwardly facing contact spring and the second portion of the forwardly facing contact spring diverge from one another at a rate that exceeds a first angle of 10 degrees as the first portion of the rearwardly facing contact spring and the second portion of the forwardly facing contact spring extend away from the line of contact; and b) the second portion of the rearwardly facing contact spring and the first portion of the forwardly facing contact spring diverge from one another at a rate that exceeds a second angle of 10 degrees as the second portion of the rearwardly facing spring contact and the first portion of the forwardly facing spring contact extend away from the line of contact.

30. The electrical connector of claim 29, wherein the first angle is greater than fifteen degrees, and the second angle is greater than fifteen degrees.

31. The electrical connector of claim 29, wherein the first angle is greater than twenty degrees, and the second angle is greater than twenty degrees.

32. The electrical connector of claim 29, wherein the first angle is greater than twenty degrees, and the second angle is greater than thirty degrees.

33. The electrical connector of claim 29, wherein the first angle is greater than the second angle.

* * * * *